United States Patent [19]

Kiyota et al.

[11] Patent Number: 4,938,810

[45] Date of Patent: Jul. 3, 1990

[54] HEAT-RESISTANT, WEAR-RESISTANT, AND HIGH-STRENGTH ALUMINUM ALLOY POWDER AND BODY SHAPED THEREFROM

[75] Inventors: Fumio Kiyota; Tatsuo Fujita, both of Kashiwazaki; Tadao Hirano; Shin'ichi Horie, both of Chichibu, all of Japan

[73] Assignees: Showa Denko Kabushiki Kaisha; Kabushiki Kaisha Riken, both of Tokyo, Japan

[21] Appl. No.: 259,402

[22] Filed: Oct. 18, 1988

Related U.S. Application Data

[63] Continuation of Ser. No. 168,795, Mar. 15, 1988, abandoned, which is a continuation of Ser. No. 867,883, May 16, 1986, abandoned, which is a continuation of Ser. No. 512,046, Jul. 8, 1983, abandoned.

[30] Foreign Application Priority Data

| | | | |
|---|---|---|---|
| Jul. 12, 1982 | [JP] | Japan | 57-119901 |
| Jul. 12, 1982 | [JP] | Japan | 57-119902 |
| Jul. 12, 1982 | [JP] | Japan | 57-167577 |
| Jul. 12, 1982 | [JP] | Japan | 57-157578 |

[51] Int. Cl.[5] ..... C22C 21/00

[52] U.S. Cl. ..... 148/437; 75/249; 148/438; 148/439; 148/440

[58] Field of Search ..... 148/437, 438, 439, 440; 420/548, 534, 537, 546; 75/249

[56] References Cited

U.S. PATENT DOCUMENTS 3,325,279 6/1967 Lawrence et al. ..... 420/548

*Primary Examiner*—R. Dean

*Attorney, Agent, or Firm*—Sughrue, Mion, Zinn, Macpeak & Seas

[57] ABSTRACT

The present invention relates to an aluminum alloy powder.

Aluminum alloy powder having a high Si content is known but its heat resistance, wear resistance, and strength are poor.

The aluminum alloy powder according to the present invention is characterized in that it contains from approximately 10.0% to approximately 30.0% of silicon and at least one element selected from the group consisting of from approximately 5.0% to approximately 15.0% of nickel, from approximately 3.0% to approximately 15.0% of iron, and from approximately 5.0% to approximately 15.0% of manganese, the silicon crystals in the aluminum alloy powder being 15 μm or less in size. Due to the high content of nickel, iron, and manganese, the matrix is hardened and strengthed by the presence of finely dispersed intermetallic compounds and the silicon crystals, and thereby the high-temperature characteristics are improved.

The shaped body, e.g., a hot-extruded shaped body, according to the present invention comprises an aluminum alloy having the above composition powder of the present invention and preferably a solid lubricant, the silicon crystals in the shaped body being 15 μm or less in size, and the intermetallic compounds 20 μm or less in size being finely distributed in the shaped body.

The high-temperature characteristics of the shaped body are very excellent, thereby enabling it to be used as a cylinder liner which is inserted into an aluminum cylinder block body by casting the body.

30 Claims, 7 Drawing Sheets

HEAT-RESISTANT, WEAR-RESISTANT, AND HIGH-STRENGTH ALUMINUM ALLOY POWDER AND BODY SHAPED THEREFROM

This is a continuation of application Ser. No. 07/168,798 abandoned, which is a continuation of application Ser. No. 06/867,883 filed May 16, 1986 abandoned, which is a continuation of application Ser. No. 06/512,046 filed on July 8, 1983 abandoned.

BACKGROUND OF THE INVENTION

The present invention relates to an aluminum alloy powder which has a high silicon content and which exhibits a high strength when used at a temperature ranging from room temperature to a high temperature of, for example, 300° C. The present invention also relates to a body shaped from the aluminum alloy powder.

More particularly, the present invention relates to an aluminum alloy powder and to a body shaped therefrom which can suitably be used as a mechanical part (such as a cylinder liner of an internal-combustion engine), to which a high thermal load can be applied, and which possesses a wear resistance and a scuffing resistance.

FIELD OF THE INVENTION

Recently, there has been a trend to decrease the weight of automobiles and to employ a front-engine and front drive (FF) system therein. To accomplish this, the weight of the internal-combustion engine must be decreased. Thus, conventional cast-iron cylinder blocks are being replaced by aluminum alloy cylinder block bodies and cast-iron cylinder liners.

In the manufacture of aluminum alloy cylinder block bodies and cast-iron cylinder liners, the aluminum alloy melt is poured so that a cast-iron cylinder liner is inserted into an aluminum alloy cylinder block body. If an aluminum alloy cylinder liner can be inserted, by casting, into an aluminum alloy cylinder block body, the following advantages can be attained:

1. A light-weight cylinder block can be provided.
2. Since the heat conductivity of an aluminum alloy of a cylinder liner is far higher than that of cast iron cylinder liner and since thermal coefficient of an aluminum alloy of a cylinder liner is greater than that of cast iron of a cylinder liner and is approximately the same as that of an aluminum alloy cylinder block body, a good tight contact between the cylinder liner and cylinder block body can be achieved upon temperature elevation and, thus, an internal-combustion engine having a good heat-dissipation characteristic can be provided.
3. Because of the second advantage, the inner-wall temperature of a cylinder liner can be kept low and, thus, the life of the lubricating oil can be prolonged.
4. Because of the second advantage, a low-viscosity lubricating oil can be used and, thus, the mileage can be improved.
5. Since the thermal expansion of the aluminum alloy cylinder liner is approximately the same as that of pistons made of an aluminum alloy, the clearance between the liner and the pistons can be kept small, with the result that the amount of lubricating oil used can be decreased and the mileage can be improved.

In addition, if an aluminum alloy having a high silicon content is used as a cylinder liner, since the friction coefficient of such an alloy is low, the friction loss which occurs between the piston rings and the cylinder liner can be lessened and, thus, the mileage can be improved.

DESCRIPTION OF THE PRIOR ART

The known aluminum alloys are not satisfactory material from which to form an aluminum alloy cylinder liner, around which casting material of a cylinder block body is poured and then solidified. The percentage used herein is all by weight, unless otherwise specified.

For example, an A 390.0 alloy stipulated in an AA-Standard (Si, 16%, to 18%; Cu, 4% to 5%; Mg, 0.50% to 0.65%; Fe, 0.5%; Ti, 0.2%; Zn, 0.1%; Al, the balance) and other high silicon aluminum alloys have a great solidus-liquidus temperature range in which solid and liquid phases coexist, with the result that in order to produce sound castings, a large amount of riser is necessary. Thus, the production yield becomes low and the production cost becomes high. In addition, the coarse primary silicon crystals of the cast alloys cannot be refined very much even by means of the known refining techniques or metal-mold casting techniques. Thus, the machinability of the cast alloys is poor.

Another disadvantage which is more detrimental than the above-mentioned one is that in a cylinder block composed of an aluminum alloy cylinder block body and an aluminum alloy cylinder liner, the cylinder liner material softens when exposed to heat during the casting of the cylinder block body. Such softening not only causes the wear resistance to deteriorate but also is liable to cause chatter marks or tear marks to form on the machined surface and to make honing difficult.

Japanese Unexamined Patent Publication No. 52-109415/1977 discloses a powder-metallurgy method for forming a hollow-shaped body, in which method an aluminum alloy having approximately the same composition as the A 390.0 alloy is pulverized and then hot-extruded. More specifically, according to the disclosed method, the aluminum alloy melt is rapidly cooled and then finely pulverized by means of an atomizing method and a centrifugal force granulating method, and the resultant powder is hot-extruded. The production yield according to the disclosed method is considerably higher than that according to a casting method for producing a hollow-shaped body.

As is well known, a hypereutectic Al-Si alloy has an expansion coefficient lower than that of pure aluminum and also has a good heat resistance and wear resistance. In a hypereutectic cast Al-Si alloy, the primary silicon crystals and eutectic silicon crystals which are dispersed in the matrix generate a high high-temperature strength, a good wear resistance, and a good scuff resistance. However, since the primary silicon crystals are frequently coarse, the elongation of and the impact strength of, as well as the machinability of, a hypereutectic cast Al-Si alloy are poor. When a hypereutectic cast Al-Si alloy is used as a cylinder liner of an internal-combustion engine, the coarse primary silicon crystals may damage the opposed member.

Since the aluminum alloy melt is rapidly cooled in accordance with the method disclosed in Japanese Unexamined Patent Publication No. 52-109415/1977, the primary silicon crystals are finely divided into primary silicon crystals 20 m or less in size and the disadvantages resulting from coarse primary silicon crystals are eliminated. A hollow-shaped body having an excellent elongation and machinability and a low friction-coefficient characteristic which is inherent in high-silicon aluminum alloys can be improved.

The above-mentioned Japanese Unexamined Patent Publication No. 52-109,415/1977 also discloses that an aluminum alloy which contains from 15% to 20% Si, from 1% to 5% Cu, from 0.5% to 1.5% Mg, and from 0.5% to 1.5% Ni and a powder mixture of this aluminum alloy and SiC, Sn, or graphite can be used for extrusion to produce a hollow-shaped body.

The hollow-shaped body disclosed in Japanese Unexamined Patent Publication No. 52-109,415/1977 disadvantageously softens upon exposure to a high temperature, for example, the casting temperature of an aluminum alloy sheath around the hollow-shaped body.

SUMMARY OF THE INVENTION

It is an object of the present invention to provide an aluminum alloy material which does not have the disadvantages of the prior art, which does not appreciably soften upon exposure to a high temperature, for example, the casting temperature of an aluminum alloy sheath, and which exhibits an improved wear resistance and heat resistance.

The present invention was completed after the present inventors conducted a tracing experiment of Japanese Unexamined Patent Publication No. 52-109,415/1977. In the tracing experiment, a cylinder liner having an outer diameter of 73 mm, an inner diameter of 65 mm, and a height of 105 mm was produced by hot-extruding an aluminum alloy powder consisting of 20.0% Si, 4.0% Cu, 0.8% Mg, and 0.5% Ni, the balance being Al, and then subjecting the hot-extruded body to $T_6$ treatment. The hardness of the cylinder liner was $HR_B$ 80. A JIS-ADC-12 alloy melt having a temperature of 675° C. was poured and then solidified around the cylinder liner by means of die-casting so as to insert the cylinder liner into the cylinder block body having a weight of 3.4 kg. As a result of die-casting, the hardness of the cylinder liner decreased from $HR_B$ 80 to approximately $HR_B$ 40.

After conducting the above-described tracing experiment, the present inventors conducted a number of other experiments and completed the present invention.

In accordance with the present invention, there is provided a heat-resistant, wear-resistant, and high-strength aluminum alloy powder which contains from approximately 10.0% to approximately 30.0% of silicon and at least one element selected from the group consisting of from approximately 5.0% to approximately 15.0% of nickel, from approximately 3.0% to approximately 15.0% of iron, and from approximately 5.0% to approximately 15.0% of manganese, the silicon crystals in the aluminum alloy powder being 15 μm or less in size. The aluminum alloy powder may contain, if necessary, from approximately 0.5% to approximately 5.0% of copper and/or from approximately 0.2% to approximately 3.0% of magnesium.

In accordance with the present invention, there is also provided a shaped body which comprises heat-resistant, wear-resistant, and high-strength aluminum alloy powders, the powders containing from approximately 10.0% to approximately 30.0% of silicon and at least one element selected from the group consisting of from approximately 5.0% to approximately 15.0% of nickel, from approximately 3.0% to approximately 15.0% of iron, and from approximately 5.0% to approximately 15.0% of manganese, the silicon crystals in the shaped body being 15 μm or less in size, and the intermetallic compounds 20 μm or less in size comprising at least one selected element being finely distributed in the shaped body. The aluminum alloy powder may contain, if necessary, from approximately 0.5% to approximately 5.0% of copper and/or from approximately 0.2% to approximately 3.0% of magnesium. The shaped body may further contain from approximately 0.2% to approximately 5.0% of at least one solid lubricant selected from the group consisting of graphite, molybdenum disulphide ($MoS_2$), and boron nitride (BN).

The composition of the heat-resistant, wear-resistant, and high-strength aluminum alloy powder (hereinafter referred to as the aluminum alloy powder) is now explained.

Silicon is the element which crystallizes in the aluminum alloy powder. The primary and eutectic silicon crystals are dispersed in the matrix and provides the aluminum alloy powder with a good heat resistance and wear resistance. If the silicon content is less than 10%, since a hypoeutectic aluminum alloy is obtained, a hypoeutectic structure rather than primary silicon crystals is formed in the aluminum alloy powder. If the silicon content is more than 30%, the amount of primary silicon crystals becomes large, and the silicon crystals cannot be 15 μm or less in size even by means of rapid cooling the molten metal.

If the silicon content is more than 30%, the thermal expansion coefficient, which decreases in accordance with an increase in the silicon content, is too low to maintain a good tight contact between the cylinder liner and the cylinder block body and to maintain a small clearance between the cylinder liner and the piston.

A preferable silicon content is from 15.0% to 25.0%.

Nickel, iron, and manganese are important elements which form intermetallic compounds and which enhance the heat resistance and wear resistance of a hypereutectic Al-Si alloy in the form of a powder. The intermetallic compounds are Ni-Si, Al-Ni-Si, Al-Fe-Si, Al-Mn-Si, Ni-Al, and Al-Mn-Fe-Si compounds and the like.

Nickel has a relatively high solubility limit in an Al-Si matrix. The nickel content effective for forming intermetallic compounds is at least approximately 5%. The intermetallic compounds comprising nickel is stable at a high temperature. If the nickel content is more than approximately 15%, the solubility limit of the silicon in an Al-Ni matrix is low and a large amount of silicon crystallizes in the aluminum alloy powder as coarse primary silicon crystals.

Iron and manganese have a relatively low solubility limit in an Al-Si matrix and a low diffusion speed in aluminum. Therefore, iron and manganese are liable to crystallize in the aluminum alloy powder as fine intermetallic compounds. The amount of primary silicon crystals is decreased and the amount of intermetallic compounds is increased in accordance with an increase in the iron and/or manganese content. The iron content and the manganese content effective for forming intermetallic compounds is at least approximately 3% and at least approximately 5%, respectively. When the iron content or manganese content is more than 15%, the hardness of an the wear resistance of the aluminum alloy powder are too low for the powder to be used for a cylinder liner, and the light-weight characteristic of the aluminum alloy is lost. In addition, the powder-metallurgical characteristics of the aluminum alloy powder are impaired. That is, during hot-extrusion of the aluminum alloy powder, the powder is not compressed in a desired manner and, therefore, the force required for extrusion is great.

Two of or all three of the elements nickel, iron, and manganese may be contained in the aluminum alloy powder. If two of these elements are used, the total content thereof should be from approximately 3% to approximately 15%. If all three are used, the total content thereof should be from approximately 6% to approximately 15%. If nickel is used in addition to iron and/or manganese, the decrease in the amount of primary silicon crystals due to the use of iron and/or manganese can be compensated for, that is, the amount of primary silicon crystals is increased due to the use of nickel. Therefore, not only a good heat resistance and wear resistance but also a considerably high scuffing resistance can be realized. Within the above-mentioned ranges of from approximately 3% to approximately 15% and from approximately 6% to approximately 15%, it is possible to attain a high high-temperature strength, a high hardness, a high wear resistance, and good powder-metallurgical characteristics.

The aluminum alloy powder may contain, if necessary, from approximately 0.5% to approximately 5.0% of copper and/or from approximately 0.2% to approximately 3.0% of magnesium, the copper and magnesium being known to be elements which render the aluminum alloys age-hardenable. The copper content and the magnesium content should be within the solubility limit at the solutioning temperature. If a shaped body is subjected to solutioning and aging, it can be effectively strengthened.

The aluminum alloy powder may contain, if necessary, titanium, zirconium, molybdenum, vanadium, and cobalt so as to further enhance the high-temperature strength thereof. However, titanium and the like, when used in a large amount, enhance the melting temperature of the aluminum alloy and make it difficult to control the aluminum composition. As a result, the aluminum alloy powder is difficult to produce.

The structure of the aluminum alloy powder is now described.

The silicon crystals in the aluminum alloy powder are primary crystals and eutectic crystals, the eutectic crystals being considerably smaller in size than the primary crystals. The primary silicon crystals must be approximately 15 μm or less in size so that: (1) the powder-metallurgical characteristics mentioned above are good, (2) the extrusion dies are not liable to quickly wear out, (3) the properties of the aluminum alloy powder do not become similar to those of a hypereutectic cast Al-Si alloy, (4) a low friction coefficient is obtained, and (5) excellent properties of the aluminum alloy powder enabling it to be used as a cylinder liner are provided. The primary silicon crystals have a nodular or square shape.

The intermetallic compounds are finely, acicular, or have a fine rod-like shape, which shape is a novel characteristic of the aluminum alloy powder and which is not attained with cast or crushed powder. The intermetallic compounds are easily finely divided by a shaping process, such as a hot-extrusion process.

The matrix of the aluminum alloy powder is a solid solution in which silicon, copper, magnesium, iron, manganese, and/or nickel are supersaturated.

The methods for forming the aluminum alloy powder are now described. The powder can be formed by means of a dispersion method, a rapid-cooling method, and a method for solidifying the aluminum alloy melt, such as an atomizing method or a centrifugal-force granulating method. By using these methods, the structure of the aluminum alloy powder can be formed while suppressing the growth of intermetallic compounds and the like. The structure of the aluminum alloy powder according to the present invention cannot be formed by a known casting and crushing methods. It should be noted that the present invention is not restricted to an atomizing or a centrifugal-force granulating method. The particles of the resultant aluminum alloy powder are usually 0.5 mm or less in diameter.

The shaped body according to the present invention is now described. The shaped body is characterized by the properties of the aluminum alloy powder and by fine intermetallic compounds, i.e., intermetallic compounds 20 m or less in size. These intermetallic compounds are obtained by finely dividing the intermetallic compounds in the aluminum alloy powder and are finely dispersed in the matrix. The fine intermetallic compounds are stable and are not liable to grow at a high temperature.

Therefore, the strength of the shaped body is not appreciably decreased upon exposure to a high temperature for a long period of time. When the shaped body is used as a cylinder liner and when it is inserted into the cast aluminum cylinder block body, the strength of the shaped body does not appreciably decrease. Furthermore, the cylinder liner is highly wear resistant even after being inserted into the cast aluminum cylinder block body.

Fine intermetallic compounds cannot be formed in a shaped body formed from a cast and crushed aluminum alloy powder and subjected to hot-extrusion because the intermetallic compounds therein are very coarse. Also, fine intermetallic compounds cannot be formed in a shaped body if the manganese content, the nickel content, and/or the iron content are more than the above-described values. The intermetallic compounds are preferably 5 μm or less in size. Usually, the majority of the intermetallic compounds are 5 μm or less in size and the remainder of the intermetallic compounds are 20 μm in size. The intermetallic compounds are finely dispersed in the shaped body.

The silicon crystals, i.e., the primary and eutectic silicon crystals, are not appreciably finely divided by hot-extrusion and are 15 μm or less in size in the shaped body. In the shaped body, the excellent properties of the aluminum alloy powder are attained due to fine primary silicon crystals and, the machinability of and the elongation of the shaped body are improved over those of the known shaped bodies.

Although hot-extrusion is generally carried out, hot-rolling, hot-pressing, hot-forging, and the like may be carried out to densely compact the particles of the alloy powder and finely divide the intermetallic compounds, thereby providing a shaped body.

The preferred hot-extrusion procedures and conditions are now described.

A green compact is first formed by means of hot pressing prior to hot-extrusion. The aluminum alloy powder is heated to a temperature of from 200° C. to 350° C. A non-oxidizing protective gas, such as $N_2$ gas or Ar gas, is desirably used at a temperature above 300° C. so as to prevent oxidation of the aluminum alloy powder. While the aluminum alloy powder is being heated to a temperature of from 200° C. to 350° C., preferably under a non-oxidizing protective gas, a pressure of from approximately 0.5 to approximately 3 tons/cm$^2$ is applied thereto. A green compact desirably has a density of 70% or more, based on the theoretical density of the aluminum alloy, so as to facilitate the handling thereof.

The hot-extrusion temperature is 350° C. or more, preferably in the range of from 400° C. to 470° C. A green compact is heated to 350° C. or more in ambient air or in a non-oxidizing protective gas and is then loaded into a container which is heated to approximately the same temperature. The extrusion ratio is preferably 10 or more so that there are no pores in the shaped body and so as to diffusion-bond the particles of the aluminum alloy powder.

The shaped body may additionally comprise a solid lubricant which renders the shaped body self-lubricating.

Graphite, molybdenum disulphide, and boron nitride are stable at a high temperature and maintain their lubricating property at a high temperature. Therefore, they are suitable for use as a solid lubricant in a cylinder liner and the like. The solid lubricant should be in a powder form and should be dispersed in the matrix of the shaped body so that under a severe sliding condition in which a lubricating oil film is discontinuous over the surface of the shaped body, the solid lubricant can prevent scuffing. Since the matrix of the shaped body consists of aluminum alloy powder and since the aluminum alloy powder exhibits a high strength at a high temperature, the solid lubricant can be reliably retained in the matrix of the shaped body and exposed on the surface of the shaped body and the matrix does not plastically flow during the sliding of, for example, the cylinder liner, which sliding generates a friction heat.

If the matrix plastically flows, the solid lubricant may be covered by the matrix.

The amount of solid lubricant effective for improving the sliding characteristic is at least approximately 0.2%. If the amount of solid lubricant is more than 5.0%, cracks may be generated during hot-extrusion of the aluminum alloy powder.

Graphite, molybdenum disulphide, and boron nitride exhibit virtually the same lubricating properties. However, molybdenum disulphide is the least stable thermally, and boron nitride is the most stable thermally. Either graphite, molybdenum disulphide, or boron nitride should, therefore, be selected depending upon the temperature to which, for example, a cylinder liner is exposed.

Since graphite, molybdenum disulphide, and boron nitride are not soluble in an aluminum alloy melt and since they have a poor wettability with respect to an aluminum alloy, it is very difficult to uniformly distribute them in an aluminum alloy melt. Therefore, they should be prepared in the form of a powder, the particles of the powder preferably being 50 m or less in size, and should be incorporated into and mixed with the aluminum alloy powder, preferably in an inert protective gas, so as to prevent the aluminum alloy powder from oxidizing. The mixed solid lubricant and aluminum alloy powder can be extruded by the same procedures and under the same conditions as described above.

BRIEF DESCRIPTION OF THE DRAWINGS

The aluminum alloy powder and the shaped body are now described with reference to the drawings.

Figure 1:
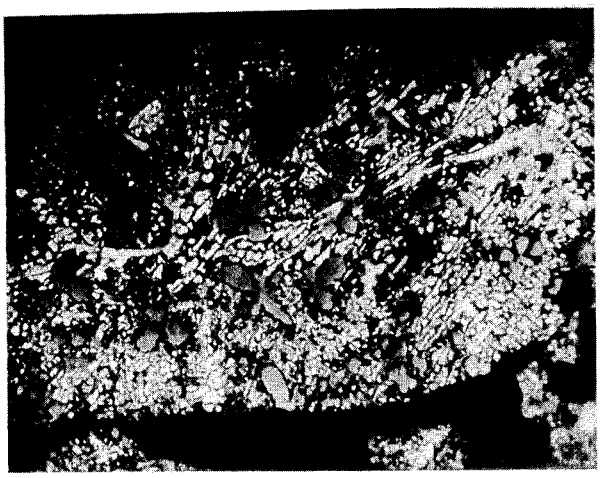
FIG. 1 is a microscopic view (X740) of the structure of an aluminum alloy powder consisting of 22.8% Si, 3.1% Cu, 1.3% Mg, 8.0% Ni, and 0.5% Fe, the balance being Al.
Figure 2:
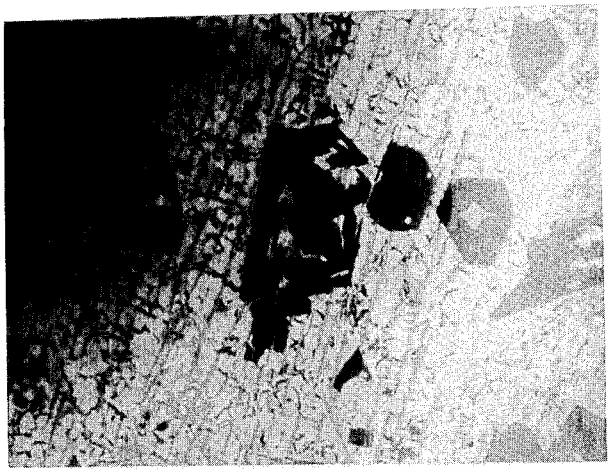
FIG. 2 is a microscopic view (X97) of the structure of a cast aluminum alloy having the same composition as the aluminum alloy powder of FIG. 1.
Figure 8:
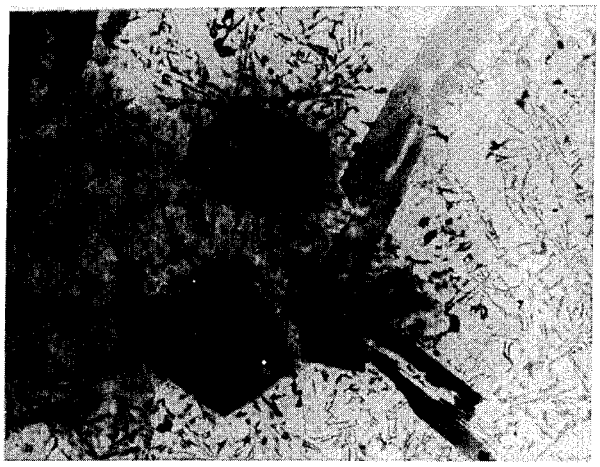
FIG. 8 is a microscopic view (X97) of the structure of a cast aluminum alloy having the same composition as the aluminum alloy powder of FIG. 6.
Figure 9:
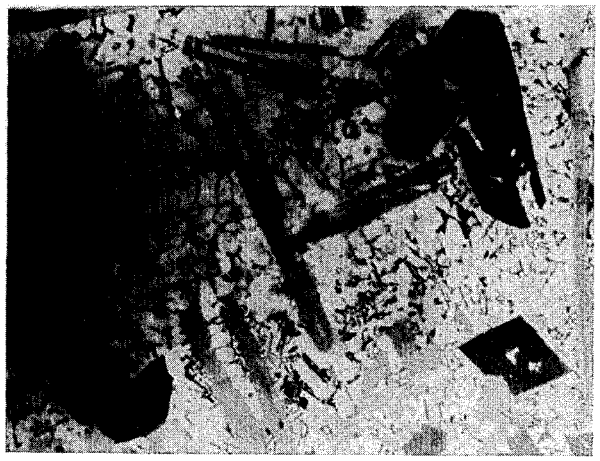
FIG. 9 is a microscopic view (X97) of the structure of a cast aluminum alloy having the same composition as the aluminum alloy powder of FIG. 7.

The silicon primary crystals were very fine in the aluminum alloy powders (FIGS. 1, 3, 6 and 7) and were coarse and polygonal in the cast aluminum alloys (FIGS. 2, 8, and 9). Al-Ni-based intermetallic compounds were coarse and rod-like in the cast aluminum alloy (FIG. 2) and were fine and rod-like in the aluminum alloy powder (FIG. 1).

The silicon crystals in the known aluminum alloy powders are primary and eutectic silicon crystals. The aluminum alloy powder according to the present invention is, therefore, structurally distinct from other aluminum alloy powders due to the fine nodular primary silicon crystals and fine intermetallic compounds.

The shaped body according to the present invention (FIG. 4) includes dark primary silicon crystals and light eutectic silicon crystals and intermetallic compounds. The fine primary silicon crystals, the fine eutectic silicon crystals, and the fine intermetallic compounds are very finely dispersed in an intricate manner, which is a structural feature of the shaped body according to the present invention. From a comparison of FIG. 4 and FIG. 5, it would be understood that, although the distribution of the silicon crystals are the same in both FIGURES, the intermetallic compounds are not formed in the shaped body according to a prior art (FIG. 5) are formed in the shaped body according to the present invention (FIG. 4).

Figure 3:
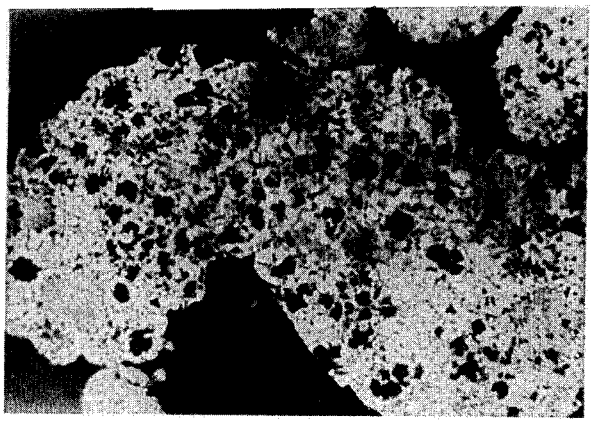
FIG. 3 is a microscopic view (X740) of the structure of a known aluminum alloy powder consisting of 21.1% Si, 3.1% Cu, and 1.0% Mg, the balance being Al.

With regard to the aluminum alloy powder containing iron (FIG. 6) and the aluminum alloy powder containing manganese (FIG. 7), the structure distinctness described above is apparent from a comparison of FIGS. 6 and 7 and FIGS. 8 and 9, respectively, and from a comparison of FIGS. 6 and 7 and FIG. 3.

Figure 4:
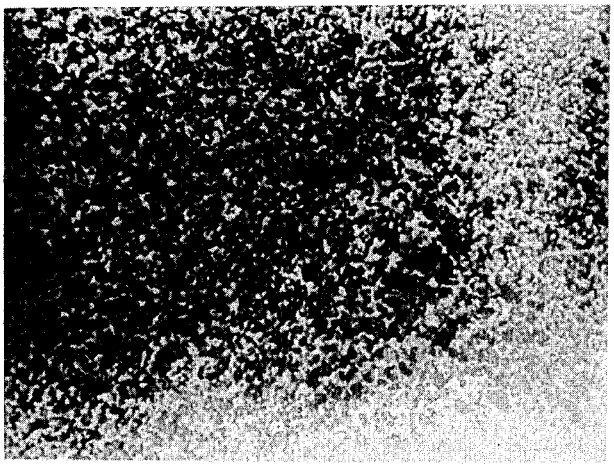
FIG. 4 is a microscopic view (X740) of the structure of a section of a hot-extruded shaped body of aluminum alloy powder, which powder is the same as that shown in FIG. 1, the section being parallel to the extrusion direction.
Figure 5:
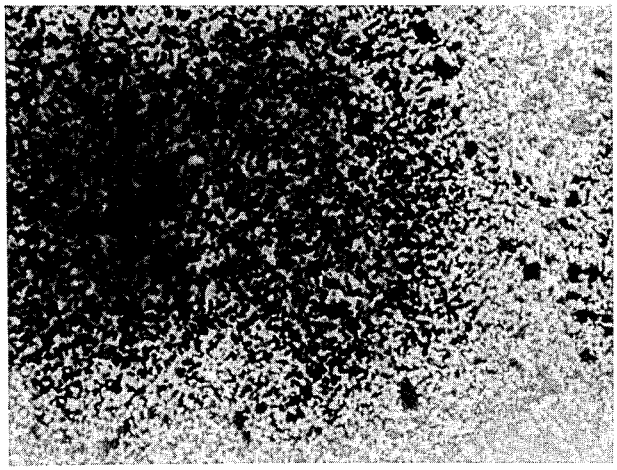
FIG. 5 which is similar to FIG. 4, is a microscopic view of a section of a hot-extruded shaped body of the aluminum alloy powder of FIG. 3.
Figure 6:
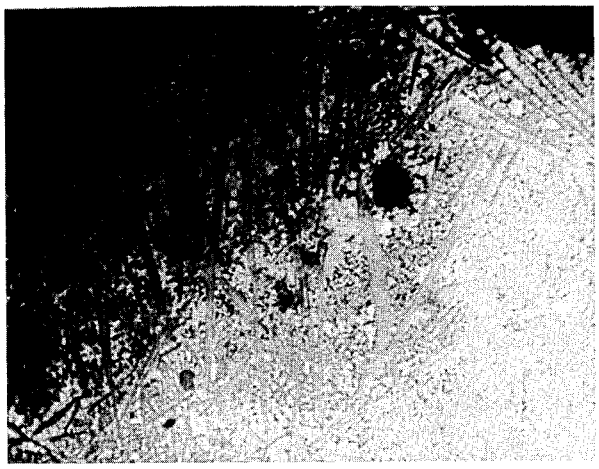
FIG. 6 is a microscopic view (X740) of the structure of an aluminum alloy powder consisting of 23.4% Si, 4.8% Cu, 1.2% Mg, and 8.7% Fe, the balance being Al.
Figure 7:
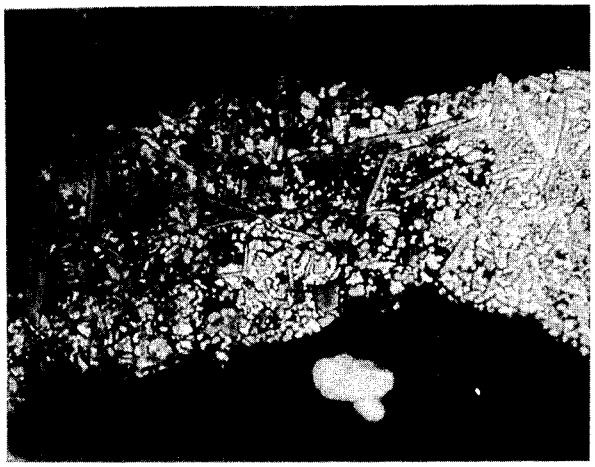
FIG. 7 is a microscopic view (X740) of the structure of an aluminum alloy powder consisting of 20.6% Si, 2.7% Cu, 1.1% Mg, and 7.8% Mn, the balance being Al.

The shaped body of the aluminum alloy powder containing an element selected from the group consisting of manganese and iron had virtually the same structure as that of FIG. 4.

When a hot-extruded shaped body contains a solid lubricant, the solid lubricant is elongated in the extrusion direction. The solid lubricant is not fused during the hot extrusion.

The present invention is further described by means of the following Examples.

EXAMPLE 1

High Si-aluminum alloy melts having the compositions given in Table 1 were atomized with inert gas to obtain aluminum alloy powders −48 mesh in size.

The aluminum alloy powders were preheated to 250° C. and then were loaded into a metal die which was heated to and held at 250° C. The aluminum alloy powders were compacted under a pressure of 1.5 tons/cm$^2$ to produce green compacts having a diameter of 100 mm and a length of 200 mm. The green compacts were heated to 450° C. and then were loaded into a container 104 mm in diameter, and the container was heated to and held at 450° C. The container was then subjected to indirect extrusion at an extrusion ratio of 12, using a die 30 mm in diameter, so as to obtain shaped bodies.

All of the shaped bodies except for No. 9 were then heated to 480° C. and held there for two hours. Then they were water-cooled and were subjected to aging at 175° C. for ten hours.

To compare the shaped bodies (Sample Nos. 1 through 10) with a cast body, an A 309.0 alloy was cast in a metal mold, and the obtained cast body was heated to 500° C. and held there for ten hours. Then the cast body was water-cooled and was subjected to aging at 175° C. for ten hours. This sample is listed in Table 1 as "Comparative Sample (Casting)".

The tensile strength, elongation, and hardness at room temperature, 200° C. and 250° C. of all of the samples were measured. The gauge length of and the diameter of a parallel portion of the specimens in which tensile strength and elongation were measured were 50 mm and 6 mm, respectively. The specimens were held at 200° C. and 250° C. for 100 hours and then a tensile force was applied thereto. The hardness at the gripped end portion of each specimen was measured after the tensile strength and elongation were measured.

TABLE 1

| Sample Nos. | Analysis Value (wt %) | Tensile Strength (kg/mm$^2$) Room Temp. | 200° C. | 250° C. | Elongation (%) Room Temp. | 200° C. | 250° C. |
|---|---|---|---|---|---|---|---|
| Comparative Samples (Powders) | | | | | | | |
| 1 | 17.4 Si—2.9.Cu—0.5 Mg—Al bal | 45.4 | 19.1 | 10.1 | 0.6 | 8.0 | 17.1 |
| 2 | 21.1 Si—3.1 Cu—1.0 Mg—Al bal | 43.5 | 20.5 | 10.1 | 0.6 | 7.5 | 16.3 |
| 3 | 20.0 Si—3.1 Cu—1.1 Mg—0.5 Zr—Al bal | 46.8 | 18.4 | 11.5 | 1.1 | 14.2 | 20.0 |
| 4 | 19.3 Si—3.3 Cu—1.1 Mg—1.7 Ti—Al bal | 48.3 | 18.0 | 14.2 | 1.0 | 9.3 | 9.9 |
| 5 | 19.4 Si—4.2 Cu—1.0 Mg—2.2 Cr—Al bal | 48.7 | 19.5 | 13.5 | 0.4 | 7.7 | 11.5 |
| 6 | 19.6 Si—3.1 Cu—1.0 Mg—2.6 Ni—Al bal | 45.6 | 20.9 | 13.2 | 0.7 | 7.5 | 14.4 |
| Invention | | | | | | | |
| 7 | 18.3 Si—3.0 Cu—1.3 Mg—0.5 Fe—5.1 Ni—Al bal | 46.8 | 24.0 | 16.9 | 0.6 | 3.6 | 8.9 |
| 8 | 22.8 Si—3.1 Cu—1.3 Mg—8.0 Ni—0.5 Fe—Al bal | 49.8 | 35.4 | 26.3 | 0.1 | 0.3 | 1.3 |
| 9 | 22.8 Si—7.9 Ni—Al bal | 43.6 | 30.0 | 23.8 | 0.4 | 1.1 | 2.3 |
| 10 | 20.1 Si—3.0 Cu—1.0 Mg—7.7 Ni | 45.0 | 28.7 | 19.7 | 0.3 | 1.6 | 2.6 |
| Comparative Samples (Casting) | 17.4 Si—4.6 Cu—0.5 Mg—Al bal | 36.0 | 21.0 | 11.0 | 0.2 | 1.0 | 2.5 |

| Sample Nos. | Hardness (HRB) Room Temp. | 200° C. | 250° C. | Size of Primary Si Crystals (μm) | Size of Eutectic Si Crystals (μm) | Size of Intermetallic Compounds Containing Ni (μm) |
|---|---|---|---|---|---|---|
| Comparative Samples (Powders) | | | | | | |
| 1 | 83 | 62 | 39 | 10 or less | 3 or less | — |
| 2 | 84 | 68 | 41 | 10 or less | 3 or less | — |
| 3 | 86 | 64 | 54 | 10 or less | 3 or less | — |
| 4 | 86 | 60 | 65 | 10 or less | 3 or less | — |
| 5 | 90 | 72 | 64 | 10 or less | 3 or less | — |
| 6 | 87 | 67 | 56 | 10 or less | 3 or less | — |
| Invention | | | | | | |
| 7 | 91 | 76 | 72 | 10 or less | 3 or less | 4 or less |
| 8 | 103 | 97 | 96 | 10 or less | 3 or less | 4 or less |
| 9 | 88 | 87 | 86 | 10 or less | 3 or less | 4 or less |
| 10 | 93 | 84 | 82 | 10 or less | 3 or less | 4 or less |
| Comparative Samples (Casting) | 83 | 59 | 24 | 70 or less | 5 or less | — |

As is apparent from Table 1, the shaped bodies according to the present invention (Sample Nos. 7 through 10) had a high-temperature strength higher than the high-temperature strength of the comparative shaped bodies (Sample Nos. 1 through 6) and the Comparative Sample (Casting). In addition, the hardness, i.e., the hardness measured after holding the samples at 200° C. and 250° C., was higher in the present invention than in the Comparative Samples and the Comparative Sample (Casting).

The shaped bodies which were formed by means of the procedure described above were cut and then hot-forged to produce discs approximately 70 mm in diameter and approximately 10 mm in thickness. The discs were machined to produce specimens for measuring the scuffing resistance, the wear resistance, and the friction coefficient.

SCUFFING RESISTANCE TEST

Figure 13:
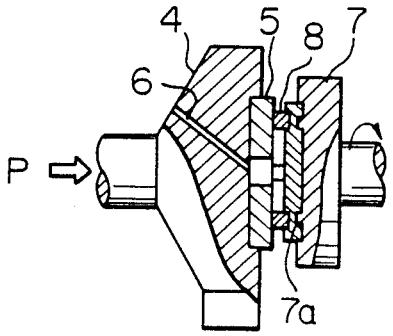
FIGS. 13 and 14 show a scuffing tester.
Figure 14:
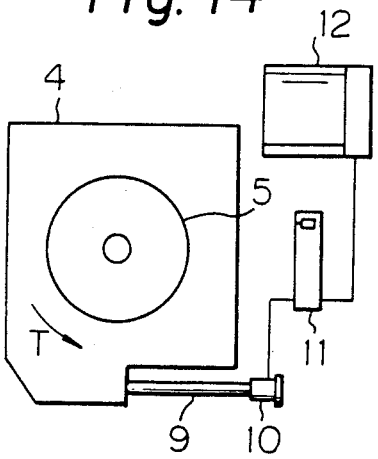

The scuffing tester used is schematically illustrated in FIGS. 13 and 14. A specimen 5 in the form of a disc 70 mm in diameter is detachably mounted on a stator 4.

Lubricating oil is supplied at a predetermined rate, via an oil orifice 6 and a central aperture, to the specimen 5. The stator 4 is operably connected with a hydraulic means (not shown) so that a predetermined pressure P can be applied in the direction of a rotor 7. The rotor 7 is arranged opposite the specimen 5, and a rotation of a predetermined velocity is imparted to the rotor 7 by means of a driving means (not shown). Four opposed-member samples 8 in the form of a four-sided prism 5 mm×5 mm×10 mm in size are detachable mounted on a holding jig *7a* secured to the circumferential end of the rotor 7. The four opposed-member samples 8 are arranged equidistantly from each other on a circular line, and the square end portions thereof, which are 5 mm×5 mm in size, are slidably in contact with the specimen 5 under the presence of lubricating oil between the opposed-member samples 8 and the specimen 5. Since friction is generated between the opposed-member samples 8 and the specimen 5 due to the rotation of the rotor 7, a torque T is generated in the stator 4. The torque T is imparted, via a spindle 9, to a load cell 10. A recorder 12 is connected, via a dynamic strain gauge 11, to the load cell 10.

The pressure P is stepwise increased hourly, and a change in the torque T is detected by the dynamic strain gauge 11 and is recorded by the recorder 12. An abrupt increase in the torque T indicates the generation of scuffing. The pressure P at this time is given in Table 2 as the scuffing surface pressure. A high scuffing surface pressure denotes a high scuffing resistance.

In the scuffing tests, samples (A) and samples (B) were combined to determine the influence of the different kinds of material of the opposed-member samples on the scuff resistance.

(A) Specimen 5: One of Sample Nos. 1, 2, 7, 8, 9, and 10, the Comparative Sample (Casting), and gray cast iron, which is conventionally used as a cylinder liner.

The heat treatment to which these samples were subjected was not the one described above but was one carried out at 300° C. for 100 hours. The heat-treated samples were grounded.

(B) Opposed-Member Samples 8: One nodular graphite cast iron body and one plated with SiC-dispersing iron sample.

The square end portion (5 mm×5 mm in size) of the nodular graphite cast iron used as the opposed-member samples 8 was plated with hard chromium. The Fe-plated SiC-dispersing body contained from 15 area % to 20 area % of SiC (averaging 0.8 μm in size) and was iron-plated on the square end portion (5 mm×5 mm in size) thereof.

Gray cast iron used as the specimen 5 and hard chromium-plated nodular graphite cast iron used as the opposed-member sample 8 are frequently used in conventional gasoline engines.

The testing conditions were as follows:

Rotation Speed: 8 m/sec

Lubricating Oil: SAE 20-based engine oil (temp., 90° C.)

Lubricating Oil Supply Rate: 300 mg/min

Contact Pressure: 20 kg/cm$^2$ for 20 min then increased to 30 kg/cm$^2$ and increased 10 kg/cm$^2$ every 3 mins The test results are given in Table 2.

TABLE 2

| Sample Nos. | Scuffing Surface Pressure (kg/cm$^2$) Opposed Member (Hard Cr.-Plated) | Opposed Member (Plated with SiC-dispersing Iron) |
|---|---|---|
| Comparative Samples | | |
| No. 1 | 160 | 240 |
| 2 | 160 | 230 |
| Invention | | |
| 7 | 270 | 330 |
| 8 | 280 | 330 |
| 9 | 280 | 320 |
| 10 | 280 | 330 |
| Comparative Sample A 390.0 (Casting) | 140 | 230 |
| Gray Cast Iron | 110 | 130 |

As the test results show, the scuff resistance of the shaped bodies according to the present invention was high and the difference in the scuffing seizure pressure, depending upon the material of the opposed members, was great in the Comparative Samples (Sample Nos. 1 and 2, the A 390.0 alloy, and the gray cast iron). In the samples according to the present invention, the difference in the scuffing surface resistance was small and the scuff resistance against hard chromium-plated nodular graphite cast iron was relatively high and was comparable to that against the sample plated with SiC-dispersing iron.

The above-described high scuff resistance according to the present invention seemed to be due to a large amount of hard dispersion phases in the Al matrix, which phases formed minute unevennesses suitable for retaining lubricating oil and dispersion-hardened the Al matrix so that it did not plastically flow and did not adhere to the opposed member when friction was generated.

TESTS FOR MEASURING THE WEAR AMOUNT AND THE FRICTION COEFFICIENT

The scuff tester used in the scuff resistance test was also used for measuring the wear amount and the friction coefficient.

Samples (A) and samples (B) were combined to determine the influence of the different kinds of material of the opposed-member samples on the wear amount and the friction coefficient.

(A) Sample 5: One of Samples Nos. 1, 7, 9, and 10 and gray cast iron.

The samples were heat-treated at 300° C. for 100 hours and then were grounded. The heat treatment corresponded to a heat cycle to which an aluminum cylinder liner is subjected when it is inserted into an aluminum alloy cylinder block body during casting.

(B) Opposed-member Samples 8: On nodular graphite cast iron body and one plated with SiC-dispersing iron. The opposed member samples 8 having square end portions 5 mm×5 mm in size were a hard chromium plated nodular graphite castiron and the sample plated with SiC-dispersing iron containing from 15 area % to 20 area % of SiC (averaging 0.8 μm in size).

The testing conditions were as follows:

Rotation speeds: 3 m/sec, 5 m/sec, and 8 m/sec

Lubricating Oil: SAE 20-based engine oil (temp. 90° C.)

Lubricating Oil Supply rate: 500 mg/min

Contact Pressure: 100 kg/cm$^2$

Sliding Length: 500 km when the wear amount was measured and 200 km when the friction coefficient was measured The wear amount was measured by the following procedure.

A probe was displaced on the flat surface of the samples in four directions, the directions being traverse to the sliding direction and intersecting each other by 90°, in such a manner that it tracked the worn out traces, i.e., the concavities, formed due to the test. The tracing was recorded on a chart. The surface area of the concavities was measured, and thereby the wear amount of the samples was obtained. In Table 3, the wear amount of the samples is not expressed by an absolute value but is expressed by a relative value based on the wear amount at a sliding speed of 5 m/sec, using gray cast iron as the opposed-member specimens.

The differences in height of the four opposed-member specimens were measured by means of a micrometer before and after sliding, and the average difference was calculated as the wear amount of the opposed-member specimens (see Table 3);.

The friction coefficient was determined by measuring the torque with the recorder 12 (FIG. 14) when the sliding length was 200 km.

The results of measurement of the wear amount and the friction coefficient are given in Table 3.

TABLE 3

| Sample Nos. | Heat Treatment | Hardness (HRB) | Condition: Surface Treatment of Opposed Member (Rectangular Sample) | Condition: Circumferential Speed m/sec | Wear Amount: Opposed Member (Rectangular Specimen) (μ) | Wear Amount: Disc (Relative Ratio) | Friction Coefficient |
|---|---|---|---|---|---|---|---|
| Comparative Sample | | | | | | | |
| 1 | 300° C. × 100 Hr | 38 | Hard Cr-Plated | 3 | 7 | 3.5 | 0.025 |
| | | | | 5 | 6 | 3.7 | 0.020 |
| | | | | 8 | 7 | 3.1 | 0.015 |
| | | | Plated with SiC-Dispersing Iron | 3 | 6 | 3.1 | 0.020 |
| | | | | 5 | 5 | 3.3 | 0.015 |
| | | | | 8 | 4 | 3.1 | 0.013 |
| Invention | | | | | | | |
| 7 | | 71 | Hard Cr-Plated | 3 | 5 | 1.0 | 0.015 |
| | | | | 5 | 5 | 0.9 | 0.010 |
| | | | | 8 | 4 | 0.8 | 0.009 |
| | | | Plated with SiC-Dispersing Iron | 3 | 4 | 0.9 | 0.010 |
| | | | | 5 | 4 | 0.9 | 0.009 |
| | | | | 8 | 4 | 0.7 | 0.008 |
| 9 | | 86 | Hard Cr-Plated | 3 | 5 | 1.0 | 0.020 |
| | | | | 5 | 4 | 0.9 | 0.016 |
| | | | | 8 | 4 | 1.0 | 0.013 |
| | | | Plated with SiC-Dispersing Iron | 3 | 4 | 0.9 | 0.015 |
| | | | | 5 | 4 | 0.8 | 0.009 |
| | | | | 8 | 3 | 0.9 | 0.010 |
| 10 | | 82 | Hard Cr-Plated | 3 | 5 | 0.9 | 0.017 |
| | | | | 5 | 4 | 0.8 | 0.010 |
| | | | | 8 | 5 | 0.9 | 0.011 |
| | | | Plated with SiC-Dispersing Iron | 3 | 4 | 0.9 | 0.011 |
| | | | | 5 | 3 | 0.8 | 0.010 |
| | | | | 8 | 4 | 0.8 | 0.011 |
| Comparative Sample | Flake Graphite Cast Iron | | Hard Cr-Plated | 3 | 6 | 1.1 | 0.110 |
| | | | | 5 | 5 | 1.0 | 0.105 |
| | | | | 8 | 5 | 1.1 | 0.095 |

As is apparent from Table 3, the friction coefficient of the shaped bodies according to the present invention, i.e., Sample Nos. 7, 9, and 10, was considerably less than that of the gray cast iron. Also, the wear amount of the shaped bodies according to the present invention (Sample Nos. 7, 9, and 10) was considerably less than that of the comparative shaped body (Sample No. 1) and was equal to or less than that of the gray cast iron, indicating that the shaped bodies according to the present invention had a high heat resistance and a high wear resistance which were not deteriorated under a thermal load.

The wear amount of the shaped bodies according to the present invention were not influenced by the type of surface treatment of the opposed-member samples.

EXAMPLE 2

The procedure of Example 1 was repeated to produce the samples given in Table 4. However, the heat treatments to which the samples in which the tensile strength and elongation were measured were $T_6$ treatment and 0 treatment (300° C.×10 hours) as given in Table 4. Sample No. 19 was forged (F), i.e., was not heat-treated.

Table 4 is similar to Table 1. In Table 4, Comparative Samples 1 through 6 is again given and denoted as Samples 11 through 16, respectively.

TABLE 4

| Sample Nos. | Analysis Value (wt %) | Heat Treatment | Tensile Strength (kg/mm$^2$): Room Temp. | Tensile Strength (kg/mm$^2$): 200° C. | Tensile Strength (kg/mm$^2$): 250° C. | Elongation (%): Room Temp. | Elongation (%): 200° C. | Elongation (%): 250° C. |
|---|---|---|---|---|---|---|---|---|
| Comparative Samples | | | | | | | | |

TABLE 4-continued

| | | | | | | | | |
|---|---|---|---|---|---|---|---|---|
| 11 | 17.4 Si—2.9 Cu—0.5 Mg—Al bal | $T_6$ | 45.4 | 19.1 | 10.1 | 0.6 | 8.0 | 17.1 |
| 12 | 21.1 Si—3.1 Cu—1.0 Mg—Al bal | $T_6$ | 43.5 | 20.5 | 10.1 | 0.6 | 7.5 | 16.3 |
| 13 | 20.0 Si—3.1 Cu—1.1 Mg—0.52 Zr—Al bal | $T_6$ | 46.8 | 18.4 | 11.5 | 1.1 | 14.2 | 20.0 |
| 14 | 19.3 Si—3.3 Cu—1.1 Mg—1.7 Ti—Al bal | $T_6$ | 48.3 | 18.0 | 14.2 | 1.0 | 9.3 | 9.9 |
| 15 | 19.4 Si—4.2 Cu—1.0 Mg—2.2 Cr—Al bal | $T_6$ | 48.7 | 19.5 | 13.5 | 0.4 | 7.7 | 11.5 |
| 16 | 19.6 Si—3.1 Cu—1.0 Mg—2.6 Ni—Al bal | $T_6$ | 45.6 | 20.9 | 13.2 | 0.7 | 7.5 | 14.4 |
| Invention | | | | | | | | |
| 17 | 23.6 Si—3.0 Cu—1.1 Mg—5.9 Fe—Al bal | $T_6$ | 49.5 | 25.7 | 17.8 | 0.3 | 3.5 | 4.3 |
| 18 | 23.4 Si—4.8 Cu—1.2 Mg—8.7 Fe—Al bal | $T_6$ | 50.7 | 33.8 | 25.6 | 0.1 | 2.1 | 3.9 |
| 19 | 22.0 Si—8.7 Fe—Al bal | F | 43.7 | 25.9 | 20.7 | 1.2 | 4.2 | 4.6 |
| 20 | 20.6 Si—2.7 Cu—1.1 Mg—7.8 Mn—Al bal | $T_6$ | 47.1 | 27.6 | 21.7 | 0.3 | 3.4 | 5.3 |
| 21 | 23.0 Si—7.3 Mn—Al bal | F | 40.8 | 24.5 | 20.9 | 1.1 | 34 | 3.3 |
| 22 | 21.9 Si—3.0 Cu—0.8 Mg—7.1 Mn—Al bal | O | 49.6 | 32.1 | 25.2 | 0.2 | 1.7 | 3.8 |
| 23 | 23.1 Si—3.0 Cu—0.8 Mg—10.0 Mn—Al bal | O | 51.5 | 35.9 | 28.2 | 0.1 | 1.2 | 2.2 |
| 24 | 19.8 Si—3.1 Cu—0.8 Mg—4.5 Fe—7.2 Mn—Al bal | O | 52.1 | 36.3 | 29.4 | 0.1 | 1.1 | 2.1 |
| 25 | 20.6 Si—7.5 Fe—5.1 Ni—Al bal | O | 52.2 | 35.1 | 27.0 | 0.2 | 1.0 | 3.1 |
| 26 | 19.9 Si—7.6 Mn—4.1 Ni—Al bal | O | 48.3 | 32.6 | 26.3 | 0.2 | 1.2 | 3.2 |
| 27 | 19.5 Si—4.1 Fe—6.1 Mn—3.6 Ni—Al bal | O | 50.6 | 34.3 | 28.7 | 0.1 | 1.1 | 3.1 |
| Comparative Sample (Casting) | | | | | | | | |
| 28 | 17.4 Si—4.6 Cu—0.5 Mg—Al bal | $T_6$ | 36.0 | 21.0 | 11.0 | 0.2 | 1.0 | 2.5 |

| Sample Nos. | Hardness (HRB) Room Temp. | 200° C. | 250° C. | Size of Primary Si Crystals (μm) | Size of Eutectic Si Crystals (μm) | Size of Intermetallic Compounds (μm) |
|---|---|---|---|---|---|---|
| Comparative Samples | | | | | | |
| 11 | 83 | 62 | 39 | 10 or less | 3 or less | — |
| 12 | 84 | 68 | 41 | 10 or less | 3 or less | — |
| 13 | 86 | 64 | 54 | 10 or less | 3 or less | — |
| 14 | 86 | 60 | 65 | 10 or less | 3 or less | — |
| 15 | 90 | 72 | 64 | 10 or less | 3 or less | — |
| 16 | 87 | 67 | 56 | 10 or less | 3 or less | — |
| Invention | | | | | | |
| 17 | 92 | 83 | 80 | 10 or less | 3 or less | 4 or less |
| 18 | 100 | 95 | 94 | 10 or less | 3 or less | 4 or less |
| 19 | 81 | 80 | 80 | 10 or less | 3 or less | 4 or less |
| 20 | 97 | 88 | 87 | 10 or less | 3 or less | 4 or less |
| 21 | 80 | 78 | 78 | 10 or less | 3 or less | 4 or less |
| 22 | 95 | — | — | 10 or less | 3 or less | 4 or less |
| 23 | 100 | — | — | 10 or less | 3 or less | 4 or less |
| 24 | 102 | — | — | 10 or less | 3 or less | 4 or less |
| 25 | 101 | — | — | 10 or less | 3 or less | 4 or less |
| 26 | 96 | — | — | 1 or less | 3 or less | 4 or less |
| 27 | 104 | — | — | 10 or less | 3 or less | 4 or less |
| Comparative Sample (Casting) | | | | | | |
| 28 | 83 | 59 | 24 | 70 or less | 5 or less | — |

As is apparent from Table 4, the shaped bodies according to the present invention (Sample Nos. 17 through 27) had a high-temperature strength higher than the high-temperature strength of the comparative shaped bodies (Sample Nos. 11 through 16) and Comparative Sample (Casting). In addition, the hardness, i.e., the hardness measured after holding the samples at 200° C. and 250° C., was higher in the present invention than in the comparative samples and the Comparative Sample (Casting).

Table 5, which is similar to Table 2, illustrates the results of the scuff resistance test. The results were essentially the same as those illustrated in Table 2.

TABLE 5

| Sample Nos. | Scuffing Surface Pressure ($kg/cm^2$) Opposed Member (Hard Cr.-Plated) | Opposed Member (Plated with SiC-dispersing Iron) |
|---|---|---|
| Comparative Samples | | |
| 11 | 160 | 240 |

TABLE 5-continued

| Sample Nos. | Scuffing Surface Pressure ($kg/cm^2$) Opposed Member (Hard Cr.-Plated) | Opposed Member (Plated with SiC-dispersing Iron) |
|---|---|---|
| 12 | 160 | 230 |
| Invention | | |
| 18 | 260 | 310 |
| 22 | 270 | 310 |
| 24 | 260 | 300 |
| 25 | 290 | 350 |
| 26 | 290 | 350 |
| 27 | 280 | 350 |
| Comparative Sample | | |
| 28 (A 390.0) (Casting) | 140 | 230 |
| 29 (Gray Cast Iron) | 110 | 130 |

Table 6 is similar to Table 3 and illustrates the results of measurement of the wear amount and the friction coefficient. The results were essentially the same as those in Table 3.

TABLE 6

| Sample Nos. | Hardness (HRB) | Condition: Surface Treatment of Opposed Member (Rectangular Sample) | Condition: Circumferential Speed m/sec | Wear Amount: Opposed Member (Rectangular Specimen) (μ) | Wear Amount: Disc (Relative Ratio) | Friction Coefficient |
|---|---|---|---|---|---|---|
| Comparative Sample | | | | | | |
| 11 | 38 | Hard Cr-Plated | 3 | 7 | 3.5 | 0.025 |
| | | | 5 | 6 | 3.7 | 0.020 |
| | | | 8 | 7 | 3.1 | 0.015 |
| | | Plated with | 3 | 6 | 3.1 | 0.020 |
| | | SiC-Dispersing | 5 | 5 | 3.3 | 0.015 |
| | | Iron | 8 | 4 | 3.1 | 0.013 |
| Invention | | | | | | |
| 18 | 94 | Hard Cr-Plated | 3 | 5 | 1.1 | 0.015 |
| | | | 5 | 4 | 1.1 | 0.013 |
| | | | 8 | 5 | 1.0 | 0.012 |
| | | Plated with | 3 | 4 | 0.9 | 0.010 |
| | | SiC-Dispersing | 5 | 4 | 1.0 | 0.009 |
| | | Iron | 8 | 3 | 0.9 | 0.010 |
| 22 | 95 | Hard Cr-Plated | 3 | 5 | 1.2 | 0.016 |
| | | | 5 | 4 | 1.0 | 0.011 |
| | | | 8 | 5 | 1.0 | 0.010 |
| | | Plated with | 3 | 4 | 1.1 | 0.013 |
| | | SiC-Dispersing | 5 | 3 | 0.9 | 0.010 |
| | | Iron | 8 | 3 | 0.9 | 0.009 |
| 24 | 102 | Hard Cr-Plated | 3 | 5 | 1.1 | 0.014 |
| | | Cr-Plated | 5 | 4 | 1.0 | 0.012 |
| | | | 8 | 4 | 1.1 | 0.013 |
| | | Plated with | 3 | 4 | 1.0 | 0.010 |
| | | SiC-Dispersing | 5 | 3 | 0.9 | 0.009 |
| | | Iron | 8 | 3 | 0.9 | 0.009 |
| 25 | 101 | Hard Cr-Plated | 3 | 6 | 1.1 | 0.013 |
| | | | 5 | 5 | 1.0 | 0.010 |
| | | | 8 | 4 | 1.0 | 0.010 |
| | | Plated with | 3 | 4 | 1.0 | 0.009 |
| | | SiC-Dispersing | 5 | 4 | 0.9 | 0.009 |
| | | Iron | 8 | 3 | 0.8 | 0.008 |
| 26 | 96 | Hard Cr-Plated | 3 | 5 | 1.0 | 0.009 |
| | | | 5 | 5 | 1.0 | 0.010 |
| | | | 8 | 4 | 1.1 | 0.009 |
| | | Plated with | 3 | 4 | 1.0 | 0.009 |
| | | SiC-Dispersing | 5 | 4 | 0.9 | 0.010 |
| | | Iron | 8 | 3 | 0.9 | 0.010 |
| 27 | 104 | Hard Cr-Plated | 3 | 5 | 1.0 | 0.011 |
| | | | 5 | 5 | 1.1 | 0.010 |
| | | | 8 | 4 | 1.0 | 0.010 |
| | | Plated with | 3 | 4 | 0.9 | 0.009 |
| | | SiC-Dispersing | 5 | 3 | 1.0 | 0.010 |
| | | Iron | 8 | 4 | 0.8 | 0.008 |
| Comparative Sample 29 (Gray Cast Iron) | | Hard Cr-Plated | 3 | 6 | 1.1 | 0.110 |
| | | Cr-Plated | 5 | 5 | 1.0 | 0.105 |
| | | | 8 | 5 | 1.1 | 0.095 |

EXAMPLE 3

High-Si aluminum alloy melts having the composition given in Table 7 were atomized with gas to obtain starting material powders −48 mesh in size.

A solid lubricant or lubricants in the amount(s) given in Table 7 were added to the starting material powders and were homogeneously mixed therewith with a V-type cone mixer so as to prepare a powder mixture for use in the preparation of Sample Nos. 30, 32, 33, 34, and 35. Nitrogen gas was introduced into V-type cone mixer so as to prevent oxidation of the powder mixture.

The solid lubricants were graphite powders 15 μm or less in size (trade name, KS-15; produced by LONZA Co., Ltd.), boron nitride powders 44 μm or less in size (trade name, UHP; produced by Showa Denko), and molybdenum disulfide powders 44 μm or less in size (produced by Nippon Molybdenum).

The mixed powders (Sample Nos. 30 and 32 through 35) and the starting material powders (Sample No. 31) were preheated to a temperature of 250° C., were loaded into a metal die which was heated to and held at 250° C., and were compacted under a pressure of 1.5 tons/cm$^2$ to produce green compacts 90 mm in diameter and 200 mm in length. Each green compact was inserted into a cylinder made of 5051 alloy and having an outer diameter of 100 mm, an inner diameter of 90 mm, and a length of 205 mm. An end cover having a diameter of 90 mm and a thickness of 5 mm was fitted onto one end of the cylinder, and the joint portion between the end cover and the cylinder was caulked to prevent displacement of the end cover, thereby producing an intermediate billet (shown in FIG. 12).

Figure 12:
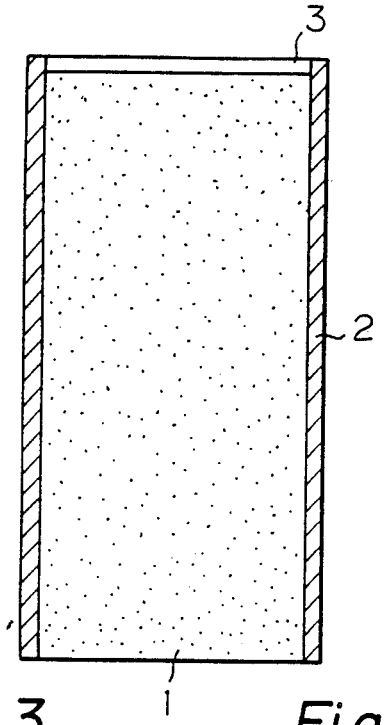
FIG. 12 schematically shows the cross-sectional structure of an intermediate billet.

In FIG. 12, reference numerals 1, 2, and 3 denote a green compact, a cylinder, and an end cover, respectively.

The billets for producing Sample Nos. 30 through 35 were hot-extruded by the following procedure. Each billet was heated to 450° C. and then was inserted into a container in such a manner that the end cover 3 was positioned to ward the forward end of the cylinder, i.e., the end of the cylinder next to the die. The cylinder had an inner diameter of 90 mm and was heated to and held at approximately 450° C. Indirect extrusion was carried out at an extrusion ratio of 12 mm, using a die 30 mm in diameter.

TABLE 7

| Sample Nos. | Composition of Starting Alloy Powder (wt %) | Addition Amt. of Solid Lubricant Added (wt %) Graphite | $MoS_2$ | BN |
|---|---|---|---|---|
| Comparative Samples | | | | |
| 30 | 20.5 Si—3.0 Cu—1.2 Mg—Al bal | 3 | 0 | 0 |
| 31 | 17.2 Si—3.4 Cu—1.3 Mg—7.7 Ni—Al bal | 0 | 0 | 0 |
| Invention | | | | |
| 32 | 17.2 Si—3.4 Cu—1.3 Mg—7.7 Ni—Al bal | 0 | 0 | 4 |
| 33 | 17.2 Si—3.4 Cu—1.3 Mg—7.7 Ni—Al bal | 3 | 0 | 0 |
| 34 | 17.2 Si—3.4 Cu—1.3 Mg—7.7 Ni—Al bal | 0 | 5 | 0 |
| 35 | 23.4 Si—3.4 Cu—1.2 Mg—8.6 Ni—Al bal | 2 | 2 | 2 |

The shaped bodies formed by indirect extrusion were subjected to tensile strength and elongation tests under the same procedures and the same conditions as in Example 1.

TABLE 8

| Sample Nos. | Tensile Strength (kg/mm²) Room Temp. | 200° C. | 250° C. | Elongation (%) Room Temp. | 200° C. | 250° C. | Hardness (HRB) Room Temp. | Size of Primary Si Crystals (μm) | Size of Eutectic Si Crystals (μm) | Size of Intermetallic Compounds (μm) |
|---|---|---|---|---|---|---|---|---|---|---|
| Comparative Samples | | | | | | | | | | |
| 30 | 30.8 | 16.5 | 11.8 | 1.5 | 6.1 | 8.5 | 55.0 | 10 or less | 3 or less | — |
| 31 | 40.0 | 29.5 | 21.5 | 0.7 | 2.6 | 6.9 | 81.8 | 10 or less | 3 or less | 4 or less |
| Invention | | | | | | | | | | |
| 32 | 40.0 | 27.7 | 20.9 | 0.3 | 1.6 | 2.7 | 79.8 | 10 or less | 3 or less | 4 or less |
| 33 | 39.0 | 29.2 | 20.9 | 0.4 | 1.8 | 3.2 | 80.0 | 10 or less | 3 or less | 4 or less |
| 34 | 38.5 | 29.3 | 21.4 | 0.3 | 0.9 | 3.9 | 83.9 | 10 or less | 3 or less | 4 or less |
| 35 | 45.5 | 32.7 | 23.9 | 0.1 | 1.6 | 2.8 | 92.0 | 10 or less | 3 or less | 4 or less |

As is apparent from Table 8, the high-temperature strength of the shaped bodies according to the present invention (Sample Nos. 32 through 35) is not low although they contain a solid lubricant. In addition, the room temperature hardness was higher in the present invention than in the comparative samples.

The microscopic structure of Sample Nos. 32 through 35 was observed with respect to the cross sections thereof parallel to and perpendicular to the extrusion direction. The microscopic structure (containing BN) of Sample No. 32 perpendicular to the extrusion direction is shown in FIG. 10, and that parallel to the extrusion direction is shown in FIG. 11.

Figure 10:
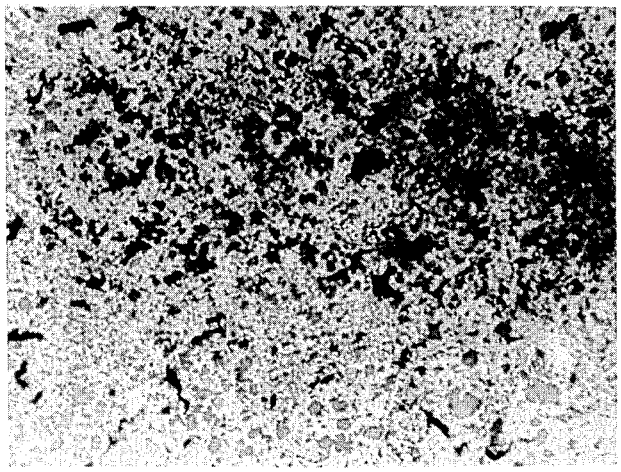
FIG. 10 is a microscopic view (X740) of the structure of a section of hot-extruded shaped body of an aluminum alloy powder (17.2% Si—3.4% Cu—1.3% Mg—7.7% Ni—bal Al) and a solid lubricant (4% BN), the section being perpendicular to the extrusion direction.
Figure 11:
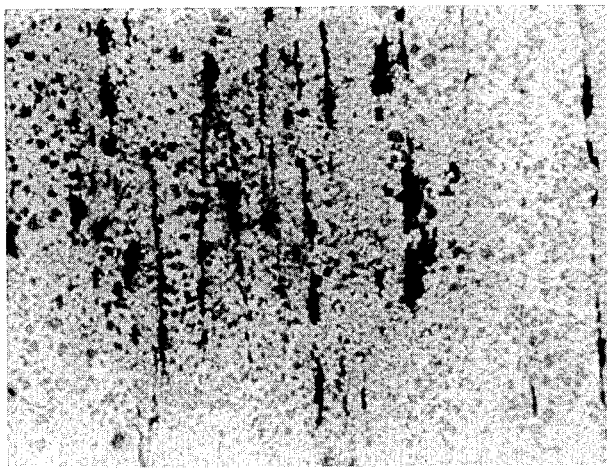
FIG. 11 is microscopic view of a section of a hot-extruded shaped body of the aluminum alloy powder of FIG. 10, the section being parallel to the extrusion direction.

In FIGS. 10 and 11, the deeply dark phases consist of a solid lubricant and somewhat consist of dark phases consisting of intermetallic compounds containing nickel. The silicon crystals appear as white particles. As is apparent from FIGS. 10 and 11, in the shaped bodies according to the present invention, the intermetallic compounds and silicon crystals were very finely and uniformly distributed as seen in both a direction perpendicular to and a direction parallel to the extrusion direction. The solid lubricant was uniformly dispersed as seen in a direction perpendicular to the extrusion direction and was elongated as seen in a direction parallel to the extrusion direction.

Samples 31, 32, 33, 34, 35, gray cast iron, and an A 390 alloy were subjected to the same scuff resistance test as in Example 1. The results are given in Table 9.

TABLE 9

| Sample Nos. | Scuffing Surface Pressure (kg/cm²) Opposed Member (Hard Cr.-Plated) | (Plated with SiC-dispersing Iron) |
|---|---|---|
| Invention | | |
| 32 | 300 | 350 |
| 33 | 330 | 380 |
| 34 | 340 | 390 |
| 35 | 340 | 390 |
| Comparative Samples | | |
| 31 | 270 | 320 |
| Gray Cast Iron | 100 | 120 |
| A390 Metal Mold Casting | 140 | 230 |

As is apparent from Table 9, the scuff-resistance of the shaped bodies according to the present invention was higher than that given in Table 2. This is believed to be due to the synergistic effect of the solid lubricant and the dispersion-hardened matrix.

It was also observed in the scuff-resistance tests that scuffing was not likely to occur in the initial period of sliding. This is believed to be due to the lubricating effect of the solid lubricant.

EXAMPLE 4

The procedure in Example 3 was repeated to produce the samples given in Table 10.

TABLE 10

| Sample Nos. | Composition of Starting Alloy Powder (wt %) | Addition Amt. of Solid Lubricant Added (wt %) Graphite | $MoS_2$ | BN |
|---|---|---|---|---|
| Comparative Samples | | | | |
| 36 | 20.5 Si—3.0 Cu—1.2 Mg—Al bal | 3 | 0 | 0 |

TABLE 10-continued

| Sample Nos. | Composition of Starting Alloy Powder (wt %) | Addition Amt. of Solid Lubricant Added (wt %) Graphite | $MoS_2$ | BN |
|---|---|---|---|---|
| 37 | 23.4 Si—4.8 Cu—1.2 Mg—8.7 Fe—Al bal | 0 | 0 | 0 |
| 38 | 23.0 Si—7.3 Mn—Al bal | 0 | 0 | 0 |
| 39 | 19.8 Si—3.1 Cu—0.8 Mg—4.5 Fe—7.2 Mn—Al bal | 0 | 0 | 0 |
| 40 | 19.5 Si—4.1 Fe—6.1 Mn—3.6 Ni—Al bal | 0 | 0 | 0 |
| 41 | 20.6 Si—7.5 Fe—5.1 Ni—Al bal | 0 | 0 | 0 |
| 42 | 19.9 Si—7.6 Mn—4.1 Ni—Al bal | 0 | 0 | 0 |
| Invention | | | | |
| 43 | 23.4 Si—4.8 Cu—1.2 Mg—8.7 Fe—Al bal | 4 | 0 | 0 |
| 44 | 23.0 Si—7.3 Mn—Al bal | 2 | 1 | 0 |
| 45 | 19.8 Si—3.1 Cu—0.8 Mg—4.5 Fe—7.2 Mn—Al bal | 2 | 2 | 0 |
| 46 | 19.5 Si—4.1 Fe—6.1 Mn—3.6 Ni—Al bal | 3 | 0 | 0 |
| 47 | 20.6 Si—7.5 Fe—5.1 Ni—Al bal | 4 | 0 | 1 |
| 48 | 19.9 Si—7.6 Mn—4.1 Ni—Al bal | 2 | 2 | 2 |

Table 11 is similar to Table 8. In Table 11, the tensile strength, the elongation, and the hardness of the shaped bodies according to the present invention are essentially the same as those in Table 8.

TABLE 11

| Sample Nos. | Tensile Strength ($kg/mm^2$) 200° C. | 250° C. | Elongation (%) 200° C. | 250° C. | Hardness (Room Temp.) (HRB) | Size of Primary Si Crystals (μm) | Size of Eutectic Si Crystals (μm) | Size of Intermetallic Compounds (μm) |
|---|---|---|---|---|---|---|---|---|
| Comparative Samples | | | | | | | | |
| 36 | 16.5 | 11.8 | 6.1 | 8.5 | 55 | 10 or less | 3 or less | — |
| 37 | 33.8 | 25.6 | 3.2 | 4.2 | 92 | 10 or less | 3 or less | 4 or less |
| 38 | 24.2 | 20.3 | 4.0 | 4.2 | 77 | 10 or less | 3 or less | 4 or less |
| 39 | 36.3 | 29.4 | 1.1 | 2.1 | 102 | 10 or less | 3 or less | 4 or less |
| 40 | 34.3 | 28.7 | 1.1 | 3.1 | 104 | 10 or less | 3 or less | 4 or less |
| 41 | 35.1 | 27.0 | 1.0 | 3.1 | 101 | 10 or less | 3 or less | 4 or less |
| 42 | 32.6 | 26.3 | 1.2 | 3.2 | 96 | 10 or less | 3 or less | 4 or less |
| Invention | | | | | | | | |
| 43 | 33.0 | 24.8 | 1.5 | 2.2 | 91 | 10 or less | 3 or less | 4 or less |
| 44 | 24.0 | 20.1 | 2.0 | 3.1 | 76 | 10 or less | 3 or less | 4 or less |
| 45 | 36.3 | 28.9 | 0.5 | 1.1 | 102 | 10 or less | 3 or less | 4 or less |
| 46 | 33.9 | 27.6 | 0.8 | 1.0 | 102 | 10 or less | 3 or less | 4 or less |
| 47 | 34.5 | 27.0 | 0.6 | 1.3 | 100 | 10 or less | 3 or less | 4 or less |
| 48 | 32.5 | 26.0 | 0.7 | 1.8 | 95 | 10 or less | 3 or less | 4 or less |

The microscopic structures of the shaped bodies according to the present invention were virtually the same as those shown in FIGS. 10 and 11.

Table 12 is similar to Table 9. In Table 12, the scuffing resistance of the shaped bodies according to the present invention is virtually the same as those shown in Table 9.

TABLE 12

| Sample Nos. | Scuffing Surface Pressure ($kg/cm^2$) Opposed Member (Hard Cr.-Plated) | Opposed Member (Plated with SiC-dispersing Iron) |
|---|---|---|
| Comparative Samples | | |
| 37 | 260 | 310 |
| 38 | 220 | 290 |
| 39 | 260 | 300 |
| 40 | 280 | 350 |
| 41 | 290 | 350 |
| 42 | 290 | 350 |
| Invention | | |
| 43 | 300 | 350 |
| 44 | 280 | 340 |
| 45 | 290 | 350 |
| 46 | 330 | 390 |
| 47 | 340 | 390 |
| 48 | 340 | 390 |
| Comparative Samples | | |
| Gray Cast Iron | 100 | 120 |
| A390 | 140 | 230 |

TABLE 12-continued

| Sample Nos. | Scuffing Surface Pressure ($kg/cm^2$) Opposed Member (Hard Cr.-Plated) | Opposed Member (Plated with SiC-dispersing Iron) |
|---|---|---|
| Metal Mold Casting | | |

We claim:

1. A heat-resistant, wear resistant, and high-strength aluminum alloy powder which is formed by pulverizing and solidifying a melt, and which consists essentially of from 15.0% by weight to 25% by weight silicon, from 5.9% by weight to 15.0% by weight iron, and at least one of from 0.5% by weight to 5.0% by weight of copper and from 0.2% by weight to 3.0% by weight of magnesium, and comprising silicon crystals and intermetallic compounds of iron, wherein the silicon crystals in said aluminum alloy powder are 15 μm or less in size and said intermetallic compounds are finely dividable acicular crystals that are 20 μm or less in size, in a plastic deforming process of said powder.

2. A heat-resistant, wear-resistant, and high-strength aluminum alloy powder which is formed by pulverizing and solidifying a melt and which consists essentially of from 15.0% by weight to 25% by weight silicon, from 7.1% by weight to 15.0% by weight manganese, and at least one of 0.5% by weight to 5.0% by weight of copper and from 0.2% by weight to 3.0% by weight of magnesium, and comprising silicon crystals and intermetallic compounds of manganese, wherein the silicon crystals in said aluminum alloy powder are 15 μm or less in size and said intermetallic compounds are finely dividable acicular crystals that are 20 μm or less in size, in a plastic deforming process of said powder.

3. A heat-resistant, wear-resistant, and high-strength aluminum alloy powder which is formed by pulverizing and solidifying a melt and which consists essentially of from 15.0% by weight to 25% by weight silicon, from 7.7% by weight to 15.0% by weight nickel, and at least one of from 0.5% by weight to 5.0% by weight of copper and from 0.2% by weight to 3.0% by weight of magnesium, and comprising silicon crystals and intermetallic compounds of nickel, wherein the silicon crystals in said aluminum alloy powder are 15 μm or less in size and said intermetallic compounds are finely dividable acicular crystals that are 20 μm or less in size, in a plastic deforming process of said powder.

4. A heat-resistant, wear-resistant, and high strength aluminum alloy powder which is formed by pulverizing and solidifying a melt, and which consists essentially of from 15.0% by weight to 25% by weight silicon, manganese and one of 4.1% or more of nickel or 4.5% or more of iron, wherein the total amount of the manganese and nickel or iron is less than 15.0% by weight, and at least one of from 0.5% by weight to 5.0% by weight of copper and from 0.2% by weight to 3.0% by weight of magnesium, and comprising silicon crystals and intermetallic compounds of manganese and nickel or iron, wherein the silicon crystals in said aluminum alloy powder are 15 μm or less in size and said intermetallic compounds are finely dividable acicular crystals that are 20 μm or less in size, in a plastic deforming process of said powder.

5. A heat-resistant, wear-resistant, and high-strength aluminum alloy powder which is formed by pulverizing and solidifying a melt, and which consists essentially of from 15.0% by weight to 25% by weight silicon, iron and 5.1% by weight or more of nickel, wherein the total amount of nickel and iron is 15.0% by weight or less, and at least one of from 0.5% by weight of copper and from 0.2% by weight to 3.0% by weight of magnesium, and comprising silicon crystals and intermetallic compounds of iron and nickel, wherein the silicon crystals in said aluminum alloy powder are 15 μm or less in size and said intermetallic compounds are finely dividable acicular crystals that are 20 μm or less in size, in a plastic deforming process of said powder.

6. A heat-resistant, wear-resistant, and high-strength aluminum alloy powder is formed by pulverizing and solidifying a melt and which consists essentially of from 15% by weight to 25% by weight silicon, and 6 to 15% total of all three of nickel, iron, and manganese, and at least one of from 0.5% by weight to 5.0% by weight of copper and from 0.2% by weight to 3.0% by weight of magnesium, and comprising silicon crystals and intermetallic compounds of nickel, iron, and manganese, wherein the silicon crystals in said aluminum alloy powder are 15 μm or less in size and said intermetallic compounds are finely dividable acicular crystals that are 20 μm or less in size, in a plastic deforming process of said powder.

7. A heat-resistant, wear-resistant, and high-strength aluminum alloy powder according to claim 1, wherein the particles are 0.5 mm or less in diameter.

8. A heat-resistant, wear-resistant, and high-strength aluminum alloy powder according to claim 2, wherein the particles are 0.5 mm or less in diameter.

9. A heat-resistant, wear-resistant, and high-strength aluminum alloy powder according to claim 3, wherein the particles are 0.5 mm or less in diameter.

10. A heat-resistant, wear-resistant, and high-strength aluminum alloy powder according to claim 4, wherein the particles are 0.5 mm or less in diameter.

11. A heat-resistant, wear-resistant, and high-strength aluminum alloy powder according to claim 5, wherein the particles are 0.5 mm or less in diameter.

12. A heat-resistant, wear-resistant, and high-strength aluminum alloy powder according to claim 6, wherein the particles are 0.5 mm or less in diameter.

13. A shaped body of the heat-resistant, wear-resistant, and high-strength aluminum alloy powder according to claim 1, wherein the iron forms intermetallic compounds that are 20 μm or less in size and are finely distributed in said shaped body, and said shaped body has a scuff resistance higher than A 390 and a tensile strength of 24 kg/mm$^2$ or more at 200° C.

14. A shaped body of the heat-resistant, wear-resistant, and high-strength aluminum alloy powder according to claim 2, wherein the manganese forms intermetallic compounds that are 20 μm or less in size and are finely distributed in said shaped body, and said shaped body has a scuff resistance higher than A 390 and a tensile strength of 24 kg/mm$^2$ or more at 200° C.

15. A shaped body of the heat-resistant, wear-resistant, and high-strength aluminum alloy powder according to claim 3, wherein the nickel forms intermetallic compounds that are 20 μm or less in size and are finely distributed in said shaped body, and said shaped body has a scuff resistance higher than A 390 and a tensile strength of 24 kg/mm$^2$ or more at 200° C.

16. A shaped body of the heat-resistant, wear-resistant, and high-strength aluminum alloy powder according to claim 4, wherein the manganese and the nickel or iron form intermetallic compounds that are 20 μm or less in size and are finely distributed in said shaped body, and said shaped body has a scuff resistance higher than A 390 and a tensile strength of 24 kg/mm$^2$ or more at 200° C.

17. A shaped body of the heat-resistant, wear-resistant, and high-strength aluminum alloy powder according to claim 5, wherein the iron and the nickel form intermetallic compounds that are 20 μm or less in size and are finely distributed in said shaped body, and said shaped body has a scuff resistance higher than A 390 and a tensile strength of 24 kg/mm$^2$ or more at 200° C.

18. A shaped body of the heat-resistant, wear-resistant, and high-strength aluminum alloy powder according to claim 6, wherein the nickel, iron, and manganese form intermetallic compounds that are 20 μm or less in size and are finely distributed in said shaped body, and said shaped body has a scuff resistance higher than A 390 and a tensile strength of 24 kg/mm$^2$ or more at 200° C.

19. A shaped body according to claim 13, which contains from 0.2% by weight to 5.0% by weight of at least one solid lubricant selected from the group consisting of graphite, molybdenum disulphide, and boron nitride.

20. A shaped body according to claim 14, which contains from 0.2% by weight to 5.0% by weight of at least one solid lubricant selected from the group consisting of graphite, molybdenum disulphide, and boron nitride.

21. A shaped body according to claim 15, which contains from 0.2% by weight to 5.0% by weight of at least one solid lubricant selected from the group consisting of graphite, molybdenum disulphide, and boron nitride.

22. A shaped body according to claim 16, which contains from 0.2% by weight to 5.0% by weight of at least one solid lubricant selected from the group consisting of graphite, molybdenum disulphide, and boron nitride.

23. A shaped body according to claim 17, which contains from 0.2% by weight to 5.0% by weight of at least one solid lubricant selected from the group consisting of graphite, molybdenum disulphide, and boron nitride.

24. A shaped body according to claim 18, which contains from 0.2% by weight to 5.0% by weight of at least one solid lubricant selected from the group consisting of graphite, molybdenum disulphide, and boron nitride.

25. A shaped body according to claim 13, wherein the majority of the intermetallic compound acicular crystals are 5 μm or less in size and the remainder of the intermetallic compound acicular crystals are 20 μm or less in size.

26. A shaped body according to claim 14, wherein the majority of the intermetallic compound acicular crystals are 5 μm or less in size and the remainder of the intermetallic compound acicular crystals are 20 μm or less in size.

27. A shaped body according to claim 15, wherein the majority of the intermetallic compound acicular crystals are 5 μm or less in size and the remainder of the intermetallic compound acicular crystals are 20 μm or less in size.

28. A shaped body according to claim 16, wherein the majority of the intermetallic compound acicular crystals are 5 μm or less in size and the remainder of the intermetallic compound acicular crystals are 20 μm or less in size.

29. A shaped body according to claim 17, wherein the majority of the intermetallic compound acicular crystals are 5 μm or less in size and the remainder of the intermetallic compound acicular crystals are 20 μm or less in size.

30. A shaped body according to claim 18, wherein the majority of the intermetallic compound acicular crystals are 5 μm or less in size and the remainder of the intermetallic compound acicular crystals are 20 μm or less in size.

* * * * *